US005118394A

United States Patent [19]

Makino et al.

[11] Patent Number: 5,118,394

[45] Date of Patent: Jun. 2, 1992

[54] ELECTROPLATING BATH CONTAINING CITRIC ACID OR CITRATE FOR TIN OR TIN ALLOY PLATING

[75] Inventors: Toshiaki Makino, Fukui; Atsuyoshi Maeda, Kyoto, both of Japan

[73] Assignee: Murata Manufacturing Co., Ltd., Japan

[21] Appl. No.: 622,741

[22] Filed: Dec. 5, 1990

[30] Foreign Application Priority Data

Dec. 5, 1989 [JP] Japan ..... 1-317328

[51] Int. Cl.[5] ..... C25D 3/32

[52] U.S. Cl. ..... 205/253; 205/239; 205/301; 205/304

[58] Field of Search ..... 204/54.1, 44.4; 106/1.22

[56] References Cited

U.S. PATENT DOCUMENTS

| | | | |
|---|---|---|---|
| 3,749,649 | 7/1973 | Valayil | 204/44.4 |
| 4,118,289 | 10/1978 | Hsu | 204/44.4 |
| 4,163,700 | 8/1979 | Igarashi et al. | 204/54.1 |
| 4,530,741 | 7/1985 | Rosenberg | 204/54.1 |
| 4,844,780 | 7/1989 | Lee | 204/54.1 |

*Primary Examiner*—John Niebling
*Assistant Examiner*—Brian M. Bolam
*Attorney, Agent, or Firm*—Ostrolenk, Faber, Gerb & Soffen

[57] ABSTRACT

A brightener is added in the ratio of 0.5-5 g per 1 l of electric plating bath of pH 4-8 containing citric acid or citrate for tin or tin alloy plating. The brightener contains a water soluble reaction product obtained by reacting polyamine such as pentaethylenehexamine, aliphatic aldehyde such as formaldehyde, and aromatic carboxylic acid such as methyl benzoate.

9 Claims, 1 Drawing Sheet

ELECTROPLATING BATH CONTAINING CITRIC ACID OR CITRATE FOR TIN OR TIN ALLOY PLATING

BACKGROUND OF THE INVENTION

1. Field of the Invention

The present invention relates to an electroplating bath containing citric acid or citrate used for tin or tin alloy plating.

2. Description of the Background Art

Electroplating baths containing citric acid or citrate for tin or tin alloy plating are disclosed in Japanese Patent Publication Nos. 59-48874 and 59-48875.

In the former Japanese patent publication, water soluble polymer obtain polymerization of epoxy compound, and ethylene glycol, propylene glycol or glycerol is added to a tin or tin alloy plating bath of pH 4–8 containing citric acid or citrate and ammonium salt. In the latter Japanese patent publication, water soluble polymer of polyoxyethylene or derivative thereof is added to a tin or tin alloy plating bath of pH 4–8 containing citric acid or citrate and ammonium salt. Bright deposited films can be obtained by either plating bath.

SUMMARY OF THE INVENTION

It is an object of the present invention to provide new addition agents for favorably depositing bright tin or tin alloy plating films in an electroplating bath containing citric acid or citrate for tin or tin alloy plating.

More specifically, according to the present invention, to an electroplating bath of pH 4–8 containing citric acid or citrate for tin or tin alloy plating, a water soluble reaction product obtained by reacting the substances below is added:

(1) polyamine, (2) aliphatic aldehyde or aromatic aldehyde, and (3) aliphatic carboxylic acid or aromatic carboxylic acid or ester of either one of them, or aliphatic halogenated carbonyl compound or aromatic halogenated carbonyl compound.

The above-mentioned polyamine includes ethylenediamine, diethylenetriamine, triethylenetetramine, tetraethylenepentamine, pentaethylenehexamine, iminobispropylamine, hexamethylenediamine, 1,3-diaminopropane, 1,4-diaminobutane, o-phenylenediamine, p-phenylenediamine, 2,4-diaminotoluene, xylylenediamine or the like.

The aliphatic aldehyde or aromatic aldehyde includes formaldehyde, acetaldehyde, propionaldehyde, glyoxal, succindialdehyde, n-hexylaldehyde, benzaldehyde, p-tolualdehyde, salicylaldehyde, veratraldehyde, anisaldehyde, piperonal, vanillin or the like.

The aliphatic carboxylic acid or aromatic carboxylic acid includes formic acid, acetic acid, propionic acid, butyric acid, valeric acid, trimethylacetic acid, caproic acid, heptanoic acid, caprylic acid, pelargonic acid, glycolic acid, lactic acid, methoxyacetic acid, thioglycolic acid, phenylacetic acid, benzonic acid, anisic acid or the like. Instead of the above-mentioned aliphatic carboxylic acids or aromatic carboxylic acids, ester thereof or halogenated carbonyl compound thereof may be used.

The addition agent is preferably added to a plating bath in the ratio of 0.5–5 g per 1 l. This is because, if it is less than 0.5 g, bright deposited films cannot he obtained and dendrite formation is induced. On the other hand, addition over 5 g does not produce additional effect, only resulting in an increase in cost, although there is no problem in quality.

As for plating conditions, plating bath temperature of 10° through 60° C. and current density of 0.1 through 4 $A/dm^2$ are preferable.

Furthermore, the present invention can be applied to plating baths for various alloys containing tin, such as tin-lead, tin-cobalt, tin-copper, and tin-silver, other than tin.

According to the electroplating bath for tin or tin alloy plating of the present invention, dendrite formation of tin or tin alloy on an object to be plated can be restrained by the addition of the above-described addition agents to a plating bath. Accordingly, a bright electroplating film can be deposited on an object to be plated.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Example 1

Figure 1:
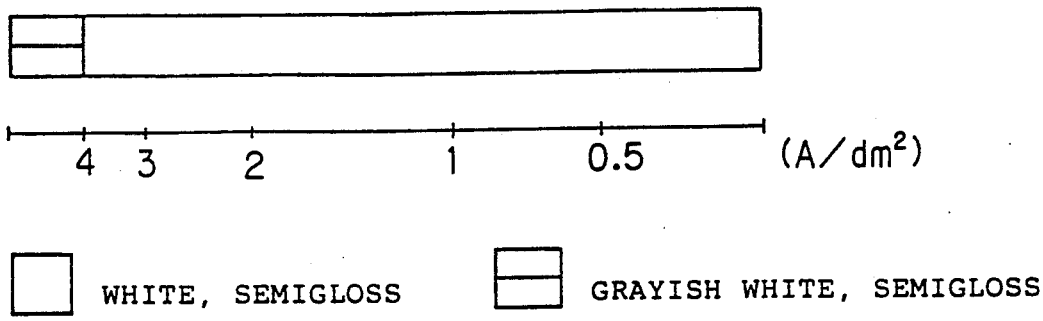
FIG. 1 is a diagram showing the relationship between current density and brightness of a plating film surface when a plating bath of Example 1 of the present invention is employed.

A brightener (2) shown below was added in the ratio of 30 ml/l to a citric acid tin plating bath (1) having the composition shown below.

Using the citric acid tin plating bath prepared in this way, electroplating of tin was applied to a brass plate using a Hull cell under conditions of a current value of 1 A and plating time of 5 minutes Here, a brass plate of 10 cm×6.5 cm was employed.

(1) Citric acid tin plating bath tin sulfate: 40 g/l
ammonium citrate: 100 g/l
ammonium sulfate: 150 g/l It was prepared to be pH 5.2 with ammonia solution and the bath temperature was 25° C.

(2) Brightener

The brightener was obtained by dissolving in 500 ml of water a reaction product obtained by adding 3 g of formaldehyde to 23 g of pentaethylenehexamine, heating the same at 180°–200° C. for 20 minutes, further adding 16 g of methyl benzoate, and heating the same at 180°–200° C. for 20 minutes.

The results of the electroplating of a current value, 1 A, and plating time, 5 minutes, on the brass plate is shown in FIG. 1.

As seen from FIG. 1, a bright deposited film without dendrite could be obtained with a current density in a large range lower than or equal to 4 A/dm$^2$.

Example 2

A brightener (4) shown below was added in the ratio of 6 ml/l to a citric acid plating bath (3) with the composition shown below.

Employing the citric acid tin plating bath prepared in this way, electroplating of tin was applied to a brass ploying a Hull cell under conditions of a current value of 1 A and plating time of 5 minutes.

Here, the same brass plate as that employed in Example 1 was employed.

(3) Citric acid tin plating bath tin sulfate: 40 g/l
citric acid: 100 g/l
sodium sulfate: 150 g/l It was prepared to be pH 5.5 with sodium hydroxide and the bath temperature was 20° C.

(4) Brightener

The brightener was obtained by dissolving in water of 200 ml a reaction product obtained by adding 3 g of formaldehyde to 19 g of tetraethylenepentamine, heating the same at 180°-200° C. for 20 minutes, further adding 14 g of salicylic acid and heating the same at 180°-200° C. for 20 minutes.

Figure 2:
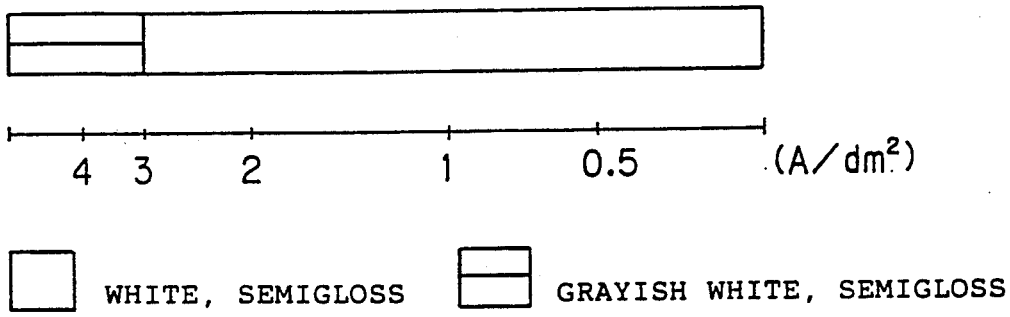
FIG. 2 is a diagram showing the relationship between current density and brightness of a plating film surface when a plating bath of Example 2 of the present invention is employed.

Electroplating with a current value of 1 A and plating time of 5 minutes for the brass plate had results as shown in FIG. 2.

As shown in FIG. 2, a bright deposited film without dendrite could be obtained with a large range of current density lower than or equal to 3 A/dm$^2$.

EXAMPLE 3

A brightener (6) shown below was added in the ratio of 10 ml/l to a citric acid tin-lead alloy plating bath (5) with the composition shown below.

Employing the citric acid tin-lead alloy plating bath prepared in this way, electroplating of tin-lead alloy was applied to a brass plate employing a Hull cell under conditions of a current value of 1 A and plating time of 5 minutes.

Here, the same brass plate as used in Example 1 was employed.

(5) Citric acid tin-lead alloy plating bath tin sulfate: 40 g/l
lead nitrate: 4 g/l
citric acid: 100 g/l
ammonium sulfate: 150 g/l It was prepared to be pH 6 with ammonia solution and the bath temperature was 20° C.

(6) Brightener

The brightener was obtained by dissolving in 200 ml of water a reaction product obtained by adding 3 g of formaldehyde to 15 g of triethylenetretramine, heating the same at 180°-200° C. for 20 minutes, further adding 14 g of salicyclic acid, and heating the same at 180°-200° C. for 20 minutes.

Figure 3:
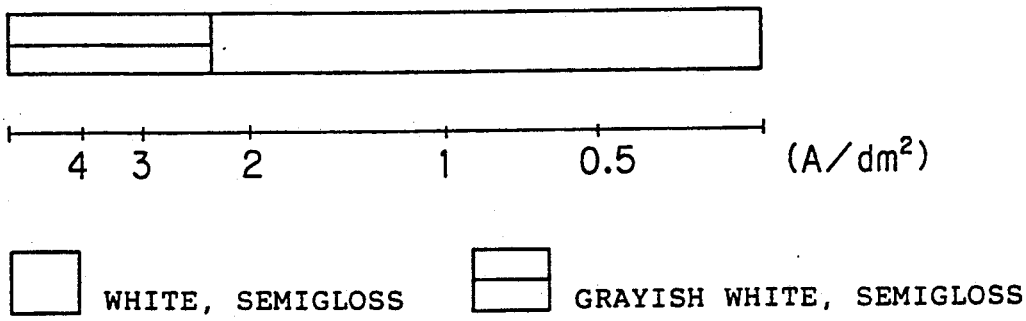
FIG. 3 is a diagram showing the relationship between a current density and brightness of a plating film surface when a plating bath according to Example 3 of the present invention is employed.

The results of electroplating with a current value of 1A and plating time of 5 minutes for the brass plate is shown in FIG. 3.

As shown in the FIG. 3, a bright deposited film without dendrite was obtained in a large range of current density lower than or equal to 2.3 A/dm$^2$.

Other than the above-described examples, bright tin or tine alloy plating films can be similarly formed by adding to a plating bath a water soluble reaction product obtained in combination of any other polyamine, aliphatic aldehyde or aromatic aldehyde and, aliphatic carboxylic acid or aromatic carboxylic acid, or ester thereof, or aliphatic or aromatic halogenated carbonyl compound.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An electroplating bath of pH 4-8 containing citric acid or citrate for tin or tin alloy plating, containing a water soluble reaction product obtained by reacting:
   (1) polyamine selected from the group consisting of ethylenediamine, diethylenetriamine, triethylenetetramine, tetraethylenepentamine, pentaethylenehexamine, iminobispropylamine, hexamethylenediamine, 1,3-diaminopropane, 1,4-diaminobutane, o-phenylenediamine, p-phenylenediamine, 2,4-diaminotoluene, and xylylendiamine;
   (2) aldehyde; and
   (3) one member selected from the group consisting of carboxylic acid or ester thereof and halogenated carbonyl compound.

2. The electroplating bath according to claim 1, wherein said water soluble reaction product is present in the ratio of 0.5-5 g per 1 l of the plating bath.

3. The electroplating bath according to claim 1, wherein said aldehyde is selected from the group consisting of formaldehyde, acetaldehyde, propionaldehyde, glyoxal, succindialdehyde, n-hexylaldehyde, benzaldehyde, p-tolualdehyde, salicylaldehyde, veratraldehyde, anisaldehyde, piperonal, and vanillin.

4. An electroplating bath of pH 4-8 containing citric acid or citrate for tin or tin alloy plating, containing a water soluble reaction product obtained by reacting:
   (1) polyamine;
   (2) aldehyde; and
   (3) carboxylic acid selected from the group consisting of formic acid, acetic acid, propionic acid, butyric acid, valeric acid, trimethylacetic acid, caproic acid, heptanoic acid, caprylic acid, pelargonic acid, glycolic acid, lactic acid, methoxyacetic acid, thioglycolic acid, phenylacetic acid, benzonic acid, and anisic acid.

5. The electroplating bath according to claim 4, wherein said aldehyde is selected from the group consisting of formaldehyde, acetaldehyde, propionaldehyde, gloxal, succindialdehyde, n-hexylaldehyde, benzaldehyde, p-tolualdehyde, salicylaldehyde, veratraldehyde, anisaldehyde, piperonal, and vanillin.

6. The electroplating bath according to claim 5, wherein said polyamine is selected from the group consisting of ethylenediamine, diethylenetriamine, triethylenetetramine, tetraethylenepentamine, pentaethylenehexamine, iminobispropylamine, hexamethylenediamine, 1,3-diaminopropane, 1,4-diminobutane, o-phenylenediamine, p-phenylenediamine, 2,4-diaminotoluene, and xylylendiamine.

7. The electroplating bath according to claim 6, wherein said water soluble reaction product is present in the ratio of 0.5–5 g per 1 l of the plating bath.

8. The electroplating bath according to claim 1, in which said polyamine is triethylenetetramine, pentaethylenehexamine or tetraethylenepentamine, said aldehyde is formaldehyde and said member of the group (3) is methyl benzoate or salicylic acid.

9. The electroplating bath according to claim 4, wherein said water soluble reaction product is present in the ratio of 0.5–5 g per 1 l of the plating bath.

* * * * *